United States Patent [19]

Hackett

[11] Patent Number: 4,574,979

[45] Date of Patent: Mar. 11, 1986

[54] DISPENSER FOR TAPE SUPPORTED LABELS

[75] Inventor: Edward J. Hackett, Scottsdale, Ariz.

[73] Assignee: Walter Allen Plummer, III, Tustin, Calif.

[21] Appl. No.: 587,610

[22] Filed: Mar. 8, 1984

[51] Int. Cl.[4] ..... B65H 5/28

[52] U.S. Cl. ..... 221/73; 225/34

[58] Field of Search ..... 221/73, 69, 70, 72; 156/584; 225/34, 37, 38, 43

[56] References Cited

U.S. PATENT DOCUMENTS

| | | | |
|---|---|---|---|
| 2,912,140 | 11/1959 | Cole | 221/73 |
| 3,603,519 | 9/1971 | Brown et al. | 225/38 |
| 3,698,600 | 10/1972 | Foote | 221/73 |
| 3,793,123 | 2/1974 | Aronson | 156/584 |
| 3,923,582 | 12/1975 | Schroter et al. | 156/584 |
| 4,262,835 | 4/1981 | Wrobel | 225/15 |

*Primary Examiner*—Joseph J. Rolla
*Assistant Examiner*—Andrew Jones
*Attorney, Agent, or Firm*—Sellers and Brace

[57] ABSTRACT

Disclosed is an improved device for dispensing individual labels slightly adherent to a roll of tape in end-to-end relation. The tape issues from a one piece container via a passage underlying the container cover and through a tubular passage extending through a guard flange along the container sidewall beneath the cover flange whereby manipulation of the tape in dispensing a label cannot open the cover. Before entering the tubular passage the tape makes a sharp bend over a protruding lip on the top edge of the container sidewall which initiates and peels the leading label from the tape and presents the advance end for grasping between the operator's fingers.

4 Claims, 3 Drawing Figures

DISPENSER FOR TAPE SUPPORTED LABELS

This invention relates to a dispenser, and more particularly to an improved dispenser for a roll of masking tape having a row of labels therealong coated with pressure sensitive adhesive and constructed with means for automatically peeling the leading label from the tape without risk of opening the dispenser cover.

BACKGROUND OF THE DISPENSER

In recent years the installation and servicing of electrical equipment having a multiplicity of conductors has presented frustrating problems as respects the identification of the individual conductors, particularly at points of connection to components. The art of using color coding techniques for identification purposes has been highly developed but has limitations in environments where the number of conductors exceeds practical color coding capabilities. To meet these needs there have been proposed various modes of applying individual conductor identifiers to the conductors. Many of these involve tagging each conductor but problems are involved in anchoring the tags to the conductors. Such tags are easily damaged, torn away or entangled with other markers, equipment or from mere handling. Other proposals dealing with these problems involve wrapping a label about the end of individual conductors marked with identifying indicia. However, this technique has involved problems in providing a supply of such labels in a manner enabling individual ones to be separated from the supply and applied to the conductor. The U.S. Pat. No. 4,262,835 to Wrobbel proposes storing a supply of ten tape rolls each imprinted with a different digit and housed in a compartmented dispenser equipped with means for severing a suitable length of a selected tape from the supply roll. A pressure sensitive coating on each of the rolls permits the user to detach a selected length and wrap it about a conductor by selecting a length of tape having a desired set of indicia and applying one or more of such lengths in side-by-side rings about the conductor. By this technique, it it possible to identify each of a very large number of adjacent conductors. Although this dispenser has certain advantages over other techniques, it is subject to numerous disadvantages obviated by this invention. For example, before use, the tape is held captive against the underside of the cover which must be opened sufficiently to permit the user to grasp the tape end and separate it from the cover surface while exercising care to avoid detaching the label prematurely and before it has been grasped. Thereafter a length must be pulled out and the cover reclosed before severing a length of the tape. Accordingly, it is apparent that the dispensing operation must be carried out with skill and in a precise manner to avoid problems.

SUMMARY OF THE INVENTION

A dispenser avoiding the shortcomings and disadvantages of prior label dispensers is disclosed in a copending U.S. application, Ser. No. 500,936 filed June 3, 1983 by Jackson R. Iblings, and assigned to the same assignee as this application now abandoned. That label dispenser has been found to embody operating principles and structural features avoiding the shortcomings of prior dispensers. However, the label dispenser of this invention embodies further improvements and simplifications not present in the aforesaid copending application.

More specifically, in the present dispenser it is unnecessary to thread the label bearing tape through a passageway formed in the dispenser cover thereby simplifying and expediting the threading operation. Additionally, the edge of the dispenser sidewall is provided with an outwardly protruding lip about the edge of which the tape passes before entering a passagway isolating the tape from the cover flange. These expedients facilitate the peeling of the label from the tape as it issues from the dispensing port and safeguards against any possibility of manipulating forces applied to the tape operating to open the dispenser cover and the possible escape and uncoiling of the roll of labels.

Accordingly, it is a primary object of the invention to provide an improved label dispenser having improved means for automatically initiating peeling of the leading label from a carrier tape as the label exits through the dispensing port.

Another object of the invention is the provision of an improved label dispenser in which a carrier tape for a roll of labels is fed through a guideway underlying the flange of the dispenser cover thereby isolating the tape from contact with the cover and any possiblity of the tape opening the cover during a dispensing operation.

Another object of the invention is the provision of a small lightweight compactly designed gang label dispenser for multiple rolls of tape each bearing a row of labels peelable therefrom and each of which rows of labels bears different distinctive indicia.

These and other more specific objects will appear upon reading the following specification and claims and upon considering in connection therewith the attached drawing to which they relate.

Referring now to the drawing in which a preferred embodiment of the invention is illustrated:

Figure 1:
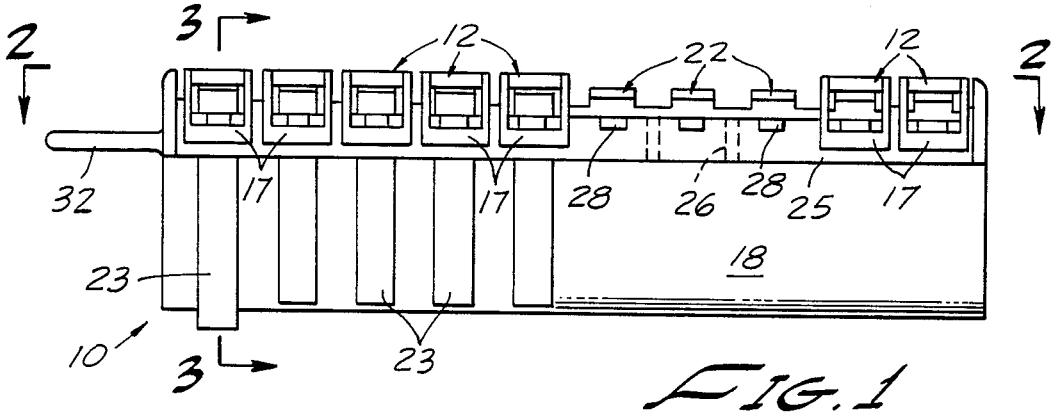
FIG. 1 is a side elevational view from the front or label issuing side of a gang label dispenser embodying the principles of this invention and showing some of the tape cell covers closed and others fully open.
Figure 2:
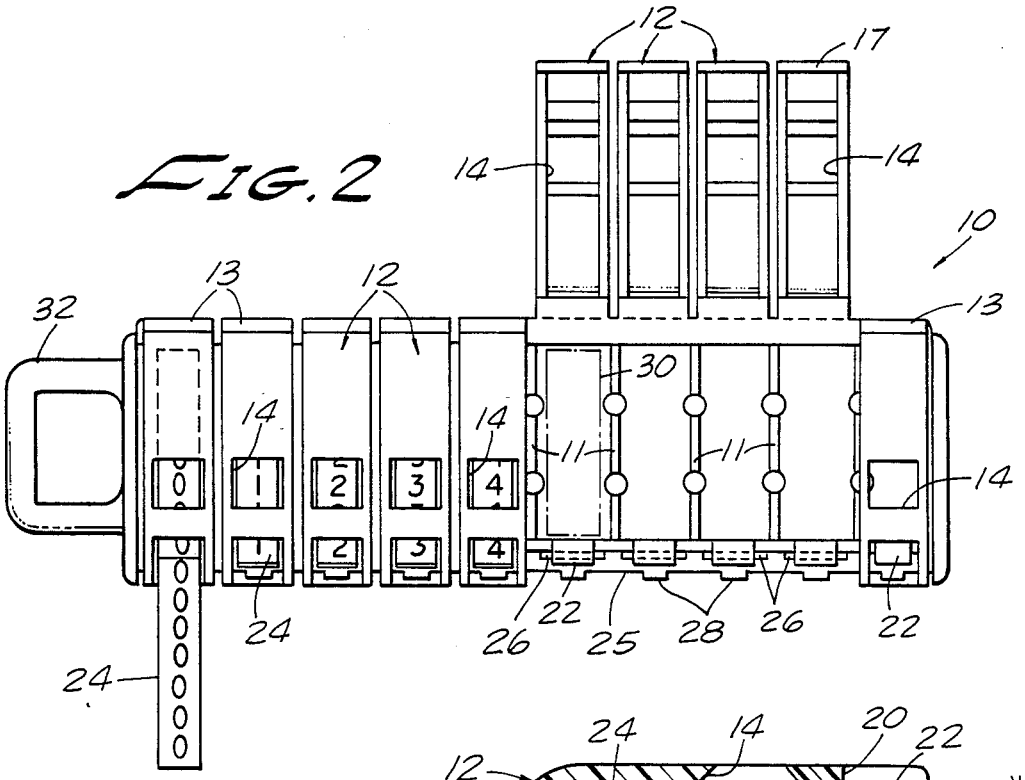
FIG. 2 is a top plan view of FIG. 1 taken along line 2—2 and showing a label from the left hand end substantially fully dispensed.
Figure 3:
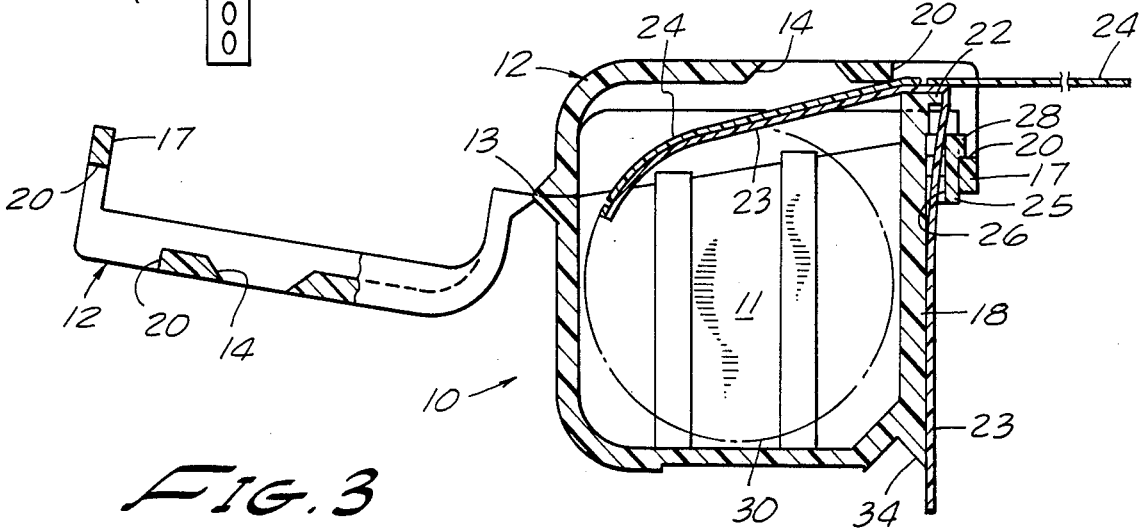
FIG. 3 is a cross sectional view on an enlarged scale taken along line 3—3 on FIG. 1.

Referring to FIGS. 1–3, there is shown an illustrative embodiment of the invention label dispenser, designated generally 10, having provision for storing ten shroudless rolls 30 of labels each imprinted with a multiplicity of indicia such as the digits 0 and 1 through 9. The dispenser, as herein shown, is molded in one piece from a suitable high strength plastic such as polypropylene. The dispenser comprises an elongated housing generally square in cross section and divided into ten label storage cells by parallel partitions 11 having their upper edge terminating below the top of the cell as is best shown in FIG. 3. Each cell is provided with an integral U-shaped cover 12 preferably, but not necessarily, connected to the rear edge of the main body by a live hinge 13 (FIG. 3). The lateral edges of the covers are closely spaced from one another so that each can be freely opened independently and without interference with adjacent covers. Each cover has a window 14 in its midlength through which the indicia on an underlying label is clearly visible as best appears from FIG. 2.

The forward end of cover 12 is provided with a downturned transverse flange 17 which, in the closed position of the cover, lies spaced outwardly from the dispenser front sidewall 18. The forward corner of the cover and its flange 17 are cut away of provide a rectangular L-shaped label dispensing port 20 embracing the upper edge of the dispenser sidewall 18.

Protruding outwardly from and flush with the upper edge of front wall 18 is a short lip 22 over which passes the masking tape 23 to which the labels 24 are adherent. Underlying lip 22 is a guard flange running the length of the sidewall directly inwardly of the lower edge of flange 17 having separate tubular passages 26 therethrough for each tape. These passages extend vertically therethrough and have a loose fit with a respective one of the masking tapes 23. On the outer side of guard flange 25 is a separate rectangular detent 28 engageable with the lower transverse edge of port 20 (FIG. 3) to retain cover 12 in closed position until cover flange 17 is manually disengaged from the detent.

As herein shown, the dispenser is provided with 10 cells separated from one another by partitions 11 each adapted to house a separate shroudless coil or roll 30 of labels 24 coated with pressure sensitive adhesive and lightly attached to masking tape 23 in end-to-end relation. Typically but not necessarily, each of the labels is sufficiently long to encircle a cable or an individual conductor to which it is to be applied and bearing a plurality of identical indicia such as the digits 0 through 9. It will of course be understood that the labels may bear other appropriate indicia of any desired design.

Many users prefer to suspend the dispenser 10 from a tool kit or from their trouser belt and this is facilitated by the presence of a ringlet 32 molded integral with one end of the dispenser housing.

In use, the dispenser cells are each loaded with a roll of labels arranged lengthwise of the masking tape. The rolls are loaded into the cells in numerical order as clearly represented in FIG. 2 and the free end of each roll is drawn slightly fowardly and threaded downwardly through the associated tubular pasage 26 in guard flange 25. As this is done the covers are closed and latched over detents 28, the free end of each tape 23 then lying along the front sidewall 18 of the dispenser with its lower end close to the sharp edged severing blade 34 (FIG. 3) extending along the lower front corner of the dispenser. As is evident from FIG. 3, a portion of the guard flange 25 extends beyond the ends of cover flanges 17. Accordingly, it is impossible to accidently release a cover from its detent while manipulating the tape to dispense a label because the guard flange isolates the cover flange 17 from the possiblity of contact with the tape.

When the user is in need of a label with a particular digit on it he grasps the free end of the associated tape and pulls it downwardly along the dispenser sidewall 18. As the tape advances about the sharper corner of lip 22 the leading label 24 gradually peels automatically from the tape and issues in a plane at right angles to front wall 18. Before it is fully dispensed the user grasps the forward end between the thumb and finger and wraps it about a conductor or other object to be identified by the digits on that label. If more than ten conductors or objects are to be identified or if the required identification symbol requires two or more digits, then separate labels bearing the required indicia are dispensed and wrapped about the object in side-by-side relation. As is made evident by FIG. 3, the operator can manipulate the free end of tape 23 in any of numerable ways without risk of opening cover 14.

While the particular dispenser for tape supported labels herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A one-piece molded plastic dispenser for dispensing individual gummed labels from a row thereof lightly attached end-to-end to a respective one of a plurality of separate shroudless coils of tape and readily peelable therefrom, said dispenser comprising:

an open-topped container divided into a plurality of open-topped cells by imperforate partitions;

a separate cover for each of said cells having a rear end connected by a live hinge across the rear end of said cell and a flange at a front end of said cell extending downwardly along but spaced outwardly from a front wall of said container, each of said covers having an open tape feed channel opening downwardly along a inner side thereof and opening into a label-dispensing port through a front corner of said covers in an area embracing a top edge of the front wall of said container;

a tubular guard flange integral with said front wall underlying each of said downturned cover flanges and equipped with detent means for holding each of said covers closed; and an unshrouded coil of tape in each of said cells each having a row of gummed labels attached thereto and imprinted with different symbols on each tape and with the leading end of each tape extending along a respective one of said tape feed channels, across the upper edge of the container front wall and then abruptly downwardly through said tubular guard flange whereby the manual advance of a selected one of said tapes is effective as the tape passes over the top edge of said front wall to progressively separate a label therefrom and dispense the same through said label-dispensing port in the associated one of said covers.

2. A one-piece molded plastic label dispenser as defined in claim 1 characterized in that each of said covers is provided with a window spaced rearwardly from said label dispensing port and through which the symbols on said labels are visible as a label approaches said label-dispensing port.

3. A one-piece molded plastic label dispenser as defined in claim 1 characterized in that said detent means includes a separate protrusion integral with and projecting outwardly from said tubular guard flange and constructed and arranged to engage an edge of said label-dispensing port in a respective one of said covers to hold said covers closed.

4. A one-piece molded plastic label dispenser as defined in claim 1 characterized in that said tubular guard flanges extend downwardly beyond the end edge of said downturned flanges on the front end of said covers to prevent releasing a cover from said detent means while manipulating an associated one of said tapes to dispense a label therefrom.

* * * * *